United States Patent [19]

Watanabe

[11] Patent Number: 4,520,338

[45] Date of Patent: May 28, 1985

[54] CYLINDRICAL FUSE

[76] Inventor: Yukinobu Watanabe, 14-13 Nakamachi 3-chome, Kiryu-shi Gumma-ken, Japan

[21] Appl. No.: 511,647

[22] Filed: Jul. 7, 1983

[30] Foreign Application Priority Data

Jul. 7, 1982 [JP] Japan ..... 57-117910
Feb. 2, 1983 [JP] Japan ..... 58-25927

[51] Int. Cl.[3] ..... H01H 85/04
[52] U.S. Cl. ..... 337/297; 337/295
[58] Field of Search ..... 337/297, 295; 357/45, 357/41

[56] References Cited

U.S. PATENT DOCUMENTS 4,394,639 7/1983 McGalliard ..... 337/297

FOREIGN PATENT DOCUMENTS 1513578 1/1970 Fed. Rep. of Germany ..... 337/297
608192 9/1960 Italy ..... 337/297
561578 5/1944 United Kingdom ..... 337/297

*Primary Examiner*—Harold Broome
*Attorney, Agent, or Firm*—Fred Philpitt

[57] ABSTRACT

Cylindrical fuses in which, when overcurrent flows to an electric circuit, the part of the electric circuit formed by metal having a low melting point is fused to maintain safety of various electric machinery and equipment.

The cylindrical fuse includes a cylindrical or bar like insulator formed of glass, porcelain, ceramics, plastics and the like and metals having a low melting point which are adhered to the cylindrical or bar like insulator by means of printing, coating, electroplating and the like, for example, lead or an alloy of lead and tin. A fuse terminal to be formed at both ends or one end of the cylindrical or bar like insulator and a fuse portion formed continuously between and connecting the fuse terminals are formed by the adhesion of the metals of low melting points.

Since the cylindrical fuse is formed by adhering a metal having a low melting point on the cylindrical or the bar like insulator, the number of component parts is relatively small, the manufacturing process is shortened and the manufacturing efficiency is tremendously elevated. This results in a large reduction in manufacturing cost when compared with conventional cylindrical fuses. Moreover, the width or the thickness of the metal of low melting point which is adhered to the cylindrical or the bar like insulator is adjusted to manufacture the various kinds of the cylindrical fuses having different allowable electric current values.

2 Claims, 27 Drawing Figures

(A)

(B)

(A)

(B)

(A)

(B)

CYLINDRICAL FUSE

SUMMARY OF INVENTION

This invention relates to cylindrical fuses in which the part of the electric circuit formed by a metal having a low melting point is fused to maintain the safety of the various electric machinery and equipment when an overcurrent flows to the electric circuit which is incorporated into various electric machinery and equipment. More particularly, this invention relates to an entirely novel cylindrical fuse formed by adhering metals having low melting points to the fuse terminals formed at both end portions or one end portion of the cylindrical or bar like insulator and the fuse portion formed continuously between the fuse terminals.

Fuses in which a part of the electric circuit is formed by a metal of low melting point, which when an overcurrent flows to the electric circuit, is fused by Joule heat to maintain the safety of the electric machinery and equipment, can be classified as non-packed fuses such as yarn fuses or plate fuses or as packed fuses such as plug fuses or cylindrical fuses. Recently, particularly small size cylindrical fuses have become popular.

However, the conventional cylindrical fuses of this kind are constructed in such a way that, as shown in FIGS. 1A and B, a fuse portion b made of a metal having a melting point which is shaped into various linear or band configurations corresponding to current allowable value, is selected and is inserted into a hollow portion of a cylindrical insulator a. Cylindrical fuse terminals c and c made of brass or the like are fitted to both end portions of the cylindrical insulator a, and the fuse portion b and the fuse terminals c and c are welded in continuity mode.

For this reason, in the manufacture of the cylindrical fuse, the manufacturing process is complicated and includes several steps such as cutting of the cylindrical insulator a into predetermined dimensions, inserting the fuse portion b into the cylindrical insulator a, fabricating the fuse terminal c, fitting of the fuse terminal c to both end portions of the cylindrical insulator a, and welding of the fuse portion b and the fuse terminals c and c and etc. Cumbersome works are required for the manufacture of the completed product because of the numerous steps in the manufacturing process and the large number of component parts. Even though there are demands for large quantities of the fuses, the fuses can not be provided at low costs which is a drawback of the conventional fuses. Also, when the overcurrent flows to the electric circuit and the fuse portion b is fused, as the fuse portion b is inserted the cylindrical insulator a, it is difficult to confirm the fusing from the outside, and the maintenance and inspection of the electric circuit is cumbersome which is another drawback of the conventional fuses.

Furthermore, the conventional fuse is manufactured by inserting the fuse portions b corresponding to various preset current allowable values into the cylindrical insulator a. The stock control of the fuse portions b of various kinds having various current allowable values was not easy, and for this reason, there are frequent cases where a separate fuse portion b having a different current allowable value is inserted into the cylindrical insulator a by oversight in the process of the manufacture of the fuse of the specific current allowable value.

Accordingly, the production control is not easy work and is another drawback of the conventional fuse.

This invention comprises an entirely novel concept and eliminates all the conventional drawbacks of the foregoing. The primary object is to provide a cylindrical fuse in which the fuse terminals are formed at both end portions or one end portion of the cylindrical or the bar like insulator and the fuse portion is formed between the fuse terminals continuously by the adhesion of metals having a low melting point. Even though this cylindrical fuse belongs to the packed fuse classification of fuses, it does not require the packing material like the conventional cylindrical fuse since the function of the packing material is provided by the surface of the cylindrical or the bar like insulator. Moreover, the number of component parts is remarkably reduced, the manufacturing process is shortened and the manufacturing efficiency is elevated, thereby resulting in large reduction in the manufacturing cost of the fuses.

Another object of this invention is to provide a cylindrical fuse in which the width or the thickness of the metal having a low melting point which is adhered to the cylindrical or bar like insulator is adjusted and the number of the fuse portions is increased or decreased, whereby various fuses having different allowable current values can be formed.

Still another object of this invention is to provide a cylindrical fuse in which when the overcurrent flows to the electric circuit and the fuse portion is fused, the fusing condition can be confirmed from outside and the maintenance and inspection of the electric circuit can be made easily rapidly and accurately.

DETAILED DESCRIPTION OF INVENTION

This invention will be described in the following in detail by referring to the accompanying drawings.

Figure 1:
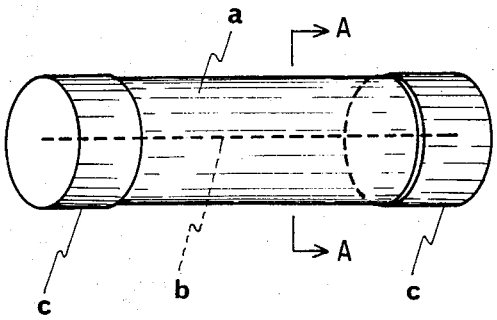
PRIOR ART FIG. 1
FIG. 1A is a perspective view of the cylindrical fuse of the prior art.
FIG. 1B is a cross sectional view taken along line A—A in FIG. 1A.
Figure 1:
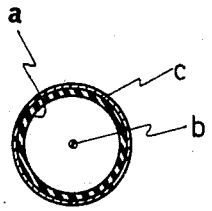
PRIOR ART FIG. 1
Figure 2:
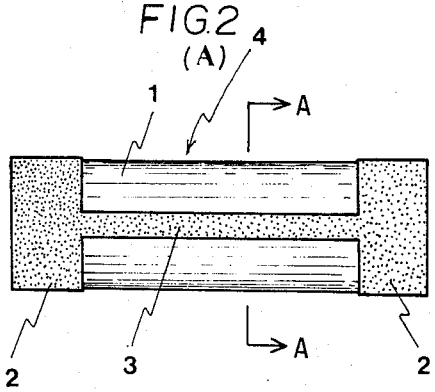
FIG. 2A is an elevation of the cylindrical fuse showing a first embodiment of this invention.
FIG. 2B is a cross sectional view taken along line A—A of FIG. 2A.
Figure 2:
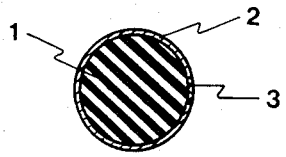
Figure 3:
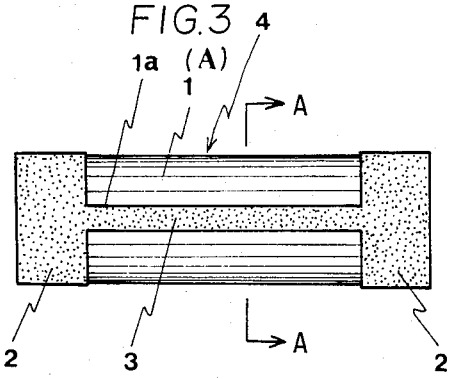
FIG. 3A is an elevation of the cylindrical fuse showing a second embodiment.
FIG. 3B is a cross sectional view taken along line A—A of FIG. 3A.
Figure 3:
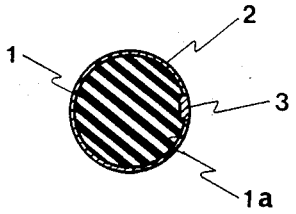
Figure 4:
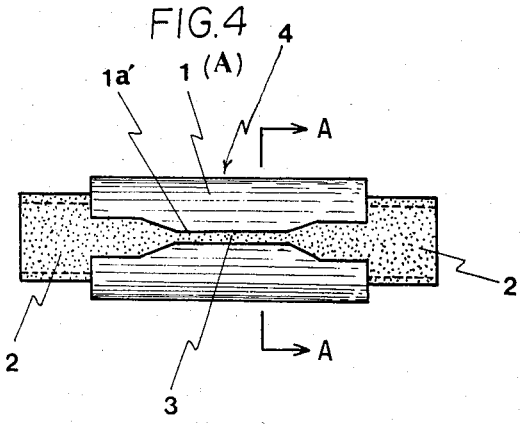
FIG. 4A is an elevation of the cylindrical fuse showing a third embodiment.
FIG. 4B is a cross sectional view taken along line A—A of FIG. 4A.
Figure 4:
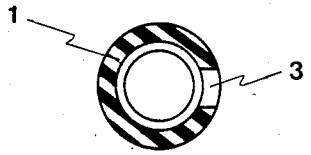
Figure 5:
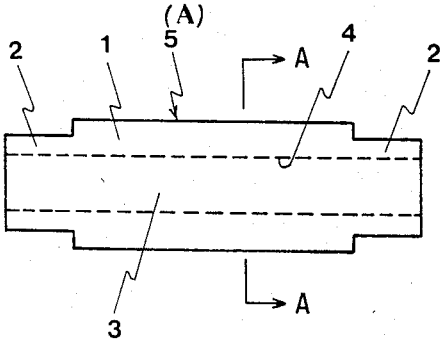
FIG. 5A is an elevation of the cylindrical fuse showing a fourth embodiment.
FIG. 5B is a cross sectional view taken along line A—A of FIG. 5A.
Figure 5:
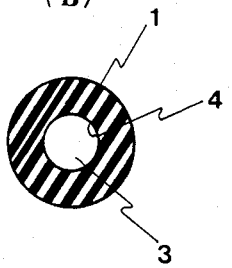
Figure 6:
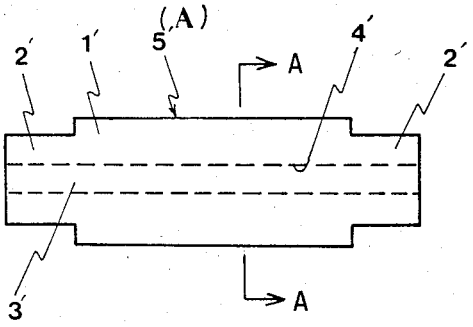
FIG. 6A is an elevation of the cylindrical fuse showing a fifth embodiment.
FIG. 6B is a cross sectional view taken along line A—A of FIG. 6A, FIGS. 7A–H are cross sectional views of the cylindrical fuse showing a sixth embodiment.
Figure 6:
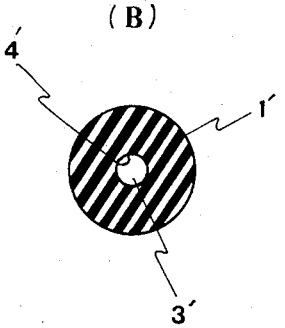
Figure 7:
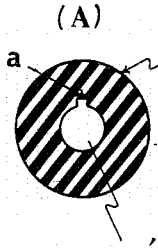
Figure 7:
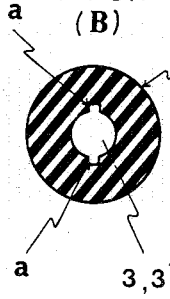
Figure 7:
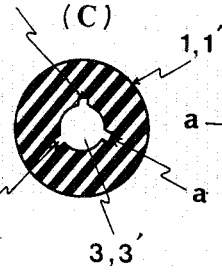
Figure 7:
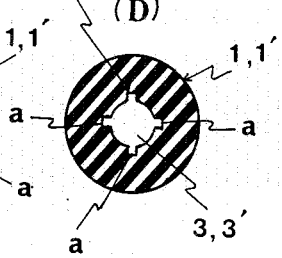
Figure 7:
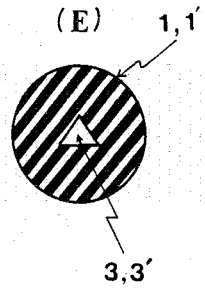
Figure 7:
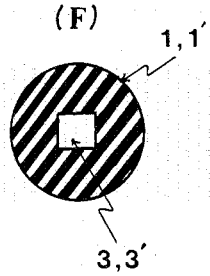
Figure 7:
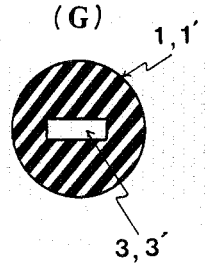
Figure 7:
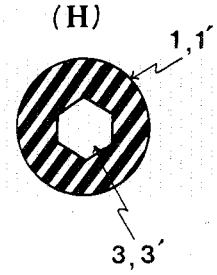

In cylindrical fuse 4 illustrated in FIG. 2 through FIG. 4, the fuse terminals and the fuse portions are formed by adhering a metal having a low melting point on the surface of the cylindrical or bar like insulator.

Namely, FIGS. 2A and B show the first embodiment of this invention, and in the drawings, numeral 1 denotes a bar like insulator formed of glass, porcelain, ceramics or plastics. At both end portions of the surface of the bar like insulator, the fuse terminals 2 and 2 are formed and are adhered with a metal having a low melting point, for example, lead or an alloy of lead and tin by means of printing, coating, electroplating and the like. Between the fuse terminals 2 and 2, the fuse portion 3 is adhered in a linear or band configuration by the metal having low melting point and is formed continuously.

FIGS. 3A and B show the second embodiment of this invention, and the cylindrical fuse 4 illustrated in the drawings is formed by inserting the fuse portion 3 which connects the fuse terminals 2 and 2 provided at both end portions of the bar like insulator 1 into the cut groove 1*a* formed in the longitudinal direction of the bar like insulator 1 by means of the metal of low melting point.

FIGS. 4A and B show the third embodiment of this invention, and the cylindrical fuse 4 illustrated in the drawings is formed in such a way that the fuse terminals 2 and 2 are formed in a step configuration at each end portion of the surface of the cylindrical insulator 1. The longitudinal direction of the cylindrical insulator 1 is notched so that the center region becomes narrow as compared with the both end regions to form a slit 1*a*', and the metal hving a low melting point is adhered to the slit 1*a*' to form the fuse portion 3 which connects the terminals 2 and 2.

In the first through the third embodiments, as the means of forming the cylindrical fuse 4 by forming the fuse terminals 2 and 2 and the fuse portion 3 on the surface of the cylindrical or bar like insulator 1, any feasible means may be employed. For example, on the cylindrical or bar like insulator 1, the portion forming the fuse terminals 2 and 2 and the portion forming the fuse portion 3 are exposed, and the remaining portions are coated with the proper material. The metal of low melting point is adhered to the insulator by means of printing, coating or electroplating and the like, and thereafter, if the coating material is removed, the cylindrical fuse 4 can be formed extremely simply.

In this case, the magnitude of the allowable current value of the fuse portion 3 can be set depending on the adjustment of the width or thickness of the metal having a low melting point which is adhered or the increase and decrease of the number of the fuse portions 3. Also, the classification of the magnitude of the allowable current value can be easily made by coloring the material forming the cylindrical fuse 4 or indicating the digits clearly.

By the way, in the first through the third embodiments, the circular shape is illustrated with respect to the cross sectional shape of the cylindrical or bar like insulator 1, but it is not limited to the circular shape, and the cross section may be optional such as triangular shape, polygonal shape and the like.

The cylindrical fuses 5 and 5' illustrated in FIG. 5 through FIG. 8 are formed so that the fuse terminal is adhered with the metal having a low melting point to both end portions of the surface of the cylindrical or bar like insulator, and the fuse portion is formed by adhering the metal of low melting point to the inner surface of the insulator.

Namely, FIGS. 5A and B show the fourth embodiment of this invention, and the cylindrical fuse 5 illustrated in the drawings is such that the metal having a low melting point is adhered to both end portions of the surface of the cylindrical insulator 1 to form fuse terminals 2 and 2 having a step configuration, and the metal having a low melting point is adhered to the peripheral surface of the hollow portion 3 formed on the cylindrical insulator in the longitudinal direction to form the fuse portion 4 connecting the fuse terminals 2 and 2 continuously.

FIGS. 6A and B show the fifth embodiment of this invention, wherein the cylindrical fuse 5' illustrated in the drawings is such that the metal having a low melting point is adhered to both end portions of the surface of the bar like insulator 1' to form the fuse terminals 2' and 2' having a step configuration, and the metal of low melting point is adhered to the peripheral surface of the long groove 3' penetrated on the bar like insulator 1' in the axial direction to form the fuse portion 4' connecting the fuse terminals 2' and 2' continuously.

In the fourth embodiment and the fifth embodiment, the circular type is illustrated with respect to the cross sectional shape of the cylindrical insulator 1 and the bar like insulator 1', but they are not limited to the shape, and any shapes such as angular, polygonal shape may be optionally employed. Also, with respect to the cross sectional shape of the hollow portion 3 of the cylindrical insulator 1 from which the fuse portion 4 is formed or the cross sectional shape of the long groove 3' of the bar like insulator 1' from which the fuse portion 4' is formed, the circular shape is illustrated in the foregoing embodiment, but, of course, they are not limited to that. For example, as shown in FIGS. 7A–H as the sixth embodiment, the fuse portion may be formed (refer to FIGS. 7A–D) with from 1 to 4 pieces of the notched grooves a in the longitudinal direction of the hollow portion 3 whose cross sectional shape is circular or in the axial direction of the long groove 3'. The fuse portion may be formed (refer to FIGS. 7E–H) in angular or polygonal shape with respect to the cross sectional shape of the hollow portion 3 or the long groove 3' and the shape is optional.

Figure 8:
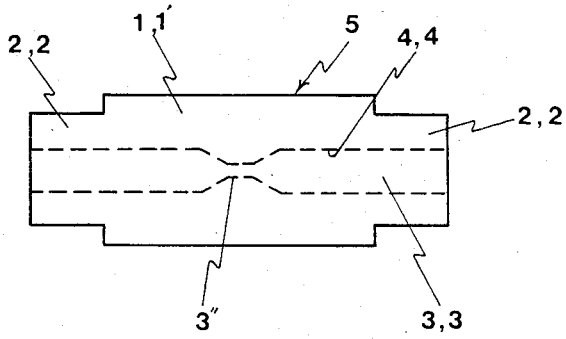
FIG. 8 is an elevation of the cylindrical fuse showing a seventh embodiment.

Furthermore, the diameter of the hollow portion 3 or the long groove 3' may not be required to be the same diameter over the entire length, and, for example, as shown in FIG. 8 as the seventh embodiment, the diameter of the center region of the cylindrical insulator 1 in the longitudinal direction or of the bar like insulator 1' in the axial direction may be formed with a diameter 3'' smaller than the diameter of both end regions.

Accordingly, even in the fourth embodiment through the seventh embodiment, it is possible to form the various fuse portions 4 and 4' of different allowable current values similar to the first embodiment through the third embodiment by selecting properly the shape of the hollow portion 3 or the long groove 3' or by increasing or decreasing the surface area to which the metal having a low melting point adheres or by adjusting the width or thickness of the metal to be adhered. Also, the classification of the magnitude of the allowable current values can be easily carried out by coloring the material forming the cylindrical fuses 5 and 5' or indicating the digits clearly.

Figure 9:
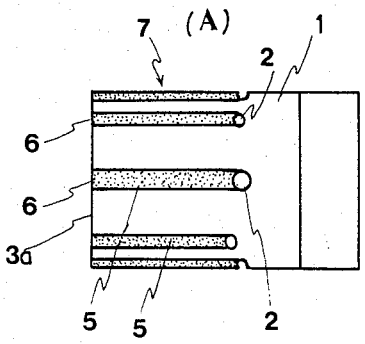
FIG. 9A is an elevation of the cylindrical fuse showing an eighth embodiment.
FIG. 9B is a side view of the fuse.

FIGS. 9A and B show the eighth embodiment of this invention, wherein the cylindrical fuse 7 illustrated in the drawings is such that a plurality of through holes 2 are perforated on the cylindrical insulator 1 in its circumferential direction at a predetermined interval. A plurality of long grooves and 4' communicating with the foregoing through holes 2 are formed in opposition on the inner and outer surfaces between the through holes 2 and the one end portion of the cylindrical insulator 1. The metal having a low melting point is adhered to the long grooves 4 and 4' to form the fuse portions 5 and 5 connecting the inner and outer surfaces continuously. As disclosed in FIGS. 9A and 10, the surfaces of portions 5 are flush or aligned with that of the insulator. The fuse terminals 6 are formed at the end portions of the fuse portions 5.

Figure 10:
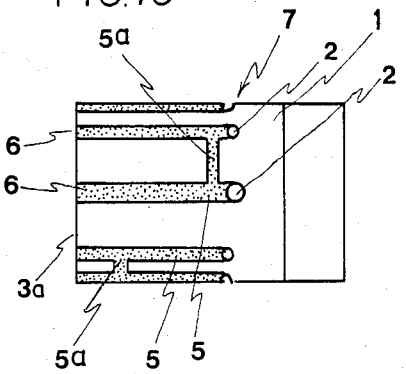
FIG. 10 is an elevation of the cylindrical fuse showing a ninth embodiment.
Figure 9:
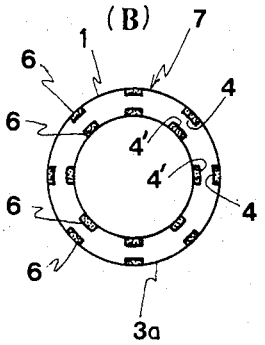

In the eighth embodiment of this invention, the same allowable current values of the fuse portions 5 are shown, but they are not limited to the same values, and it is feasible to form the various fuse portions 5 to have different allowable current values by the adjustment of the length or the width of the long grooves 4, 4' or by the adjustment of the thickness of the metal of low melting point which is adhered to the long grooves 4, 4' or by increasing or decreasing the number of pieces of the fuse portions 5. Also, as shown in FIG. 10 as the ninth embodiment, it is possible to form a fuse portion 5*a* having a large allowable current value by connecting the parts of the fuse portions of among the adjacent fuse propers.

Figure 11:
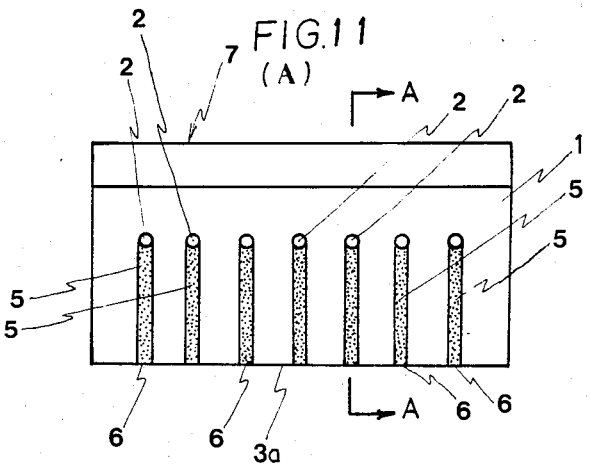
FIG. 11A is an elevation of the cylindrical fuse showing a tenth embodiment.
FIG. 11B is a cross sectional view taken along line A—A of FIG. 11A.
Figure 11:
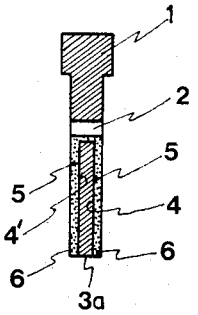

FIGS. 11A and B show the tenth embodiment of this invention, wherein the cylindrical fuse 7 illustrated in the drawings is such that the shape of the bar like insulator 1 is formed in a rectangular shape, and through holes 2, are perforated in a row at predetermined intervals along its longitudinal direction. Long grooves 4 and 4' communicating with the through holes 2 are formed in opposition on the inner and outer surfaces between the through holes 2, and the one end portion 3*a* of the bar like insulator 1. The fuse portions 5 are formed to connect the inner and outer surface in continuity by adhering the metal having a low melting point to the long grooves 4, 4'. The fuse terminals 6 are formed at the end portions of the fuse portions.

Figure 12:
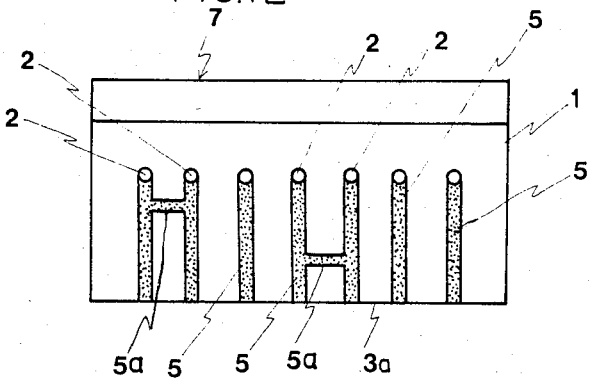
FIG. 12 is an elevation of the cylindrical fuse showing an eleventh embodiment.

Also, FIG. 12 shows the eleventh embodiment of this invention, wherein the cylindrical fuse 7 illustrated in the drawing is such that the fuse portion 5*a* having the large allowable current value as compared with the other fuse portions 5 is formed by connecting the parts of the adjacent fuse portions 5, 5 of the cylindrical fuse 7 illustrated as the tenth embodiment.

Accordingly, in the eighth embodiment through the eleventh embodiment, it is possible to form a plurality of fuse portions 5 and fuse terminals 6 on one cylindrical or bar like insulator 1, and moreover, it is possible to form various fuse portions 5 and the fuse terminals 6 such as those having the same allowable current values or those having the different allowable current values. Therefore, the cylindrical fuses 7 having the foregoing construction are extremely advantageous cylindrical fuses to be used in fuse boxes formed by collecting contacts of the electric circuit for operating the various electric equipment mounted, for example, in an automobile, or contacts of the electric circuit of various electric machinery and equipment at one location.

As will be obvious from the description of the various embodiments of this invention, the cylindrical fuse of this invention is composed of a cylindrical or bar like insulator formed of glass, porcelain, ceramics, plastics and the like and metals of low melting point which is adhered to the cylindrical or bar like insulator by means of printing, coating, electroplating and the like. The metal may comprise for example, lead or an alloy of lead and tin. A fuse terminal formed at both ends or one end of the cylindrical or bar like insulator and a fuse proper formed continuously between and connecting the fuse terminals are formed by the adhesion of the metals having low melting points so that is has the following tremendous effects as compared with the conventional cylindrical fuses of this kind.

(1) In view of the classification of fuses, it does not require packing material since the cylindrical or bar like insulator serves as the packing material and it is possible to obtain an entirely novel cylindrical of non-packed fuse similar to the yarn fuse.

(2) The number of component parts is remarkably reduced and the manufacturing process is shortened by eliminating the processes of inserting the fuse portion into the cylindrical insulator, fitting the fuse terminals to both end portions of the cylindrical insulator, welding of the fuse portion and the fuse terminals and etc. Accordingly the manufacturing efficiency is elevated which results in the large reduction of the manufacturing cost and the fuse can be provided to the customers at low cost.

(3) It is possible to set the magnitude of the allowable current value of the fuse portion by the adjustment of the width or thickness of the metal having a low melting point to be adhered to the cylindrical or bar like insulator, or increasing or decreasing the number of pieces of the fuse portion. Accordingly, the control of stock of the various fuse portions having different allowable current values found in conventional cases is no longer needed, and the control of production can be easily carried out.

(4) Since the fuse portion is formed on the surface of the cylindrical or bar like insulator and the overcurrent flows to the electric circuit and the fuse proper is fused, the fusing condition can be confirmed from the outside. Also, even in the case where the fuse portion is formed in the hollow portion of the cylindrical insulator or the long groove penetrated on the bar like insulator in the axial direction, and if the material of the insulator can be seen through from the outside, the fusing condition can be confirmed from the outside similarly so that the maintenance and inspection of the electric circuit can be carried out easily, rapidly and accurately.

What is claimed is:

1. A cylindrical fuse comprising:

(a) a tubular cylindrical electrical insulator member formed of glass, porcelain, ceramic or plastic and containing a plurality of longitudinally extending, circumferentially spaced grooves on the inner and outer surfaces thereof, each corresponding inner and outer grooves being connected at one end by a through-hole aperture;

(b) fuse portions arranged in the grooves and extending through the through-hole apertures to connect the corresponding inner and outer groove fuse portions, said fuse portions comprising a metal having a low melting point, the outer surfaces of said groove fuse portions being flush with the cylindrical surface of said insulator member, and (c) a plurality of fuse terminals formed in the end of said insulator member adjacent the ends of said groove fuse portions, the outer surfaces of said fuse terminals being flush with the end and cylindrical surfaces of said insulator member.

2. A cylindrical fuse as defined in claim 1 and further comprising lateral fuse portions extending between and connecting adjacent longitudinal groove fuse portions, said lateral fuse portions being arranged in lateral grooves contained in said insulator member, the outer surfaces of said lateral fuse portions being flush with the cylindrical surface of said insulator member.

* * * * *